US011841012B2

(12) United States Patent
Yoshii et al.

(10) Patent No.: US 11,841,012 B2
(45) Date of Patent: Dec. 12, 2023

(54) PUMP SYSTEM, FLUID SUPPLY DEVICE AND METHOD FOR CONTROLLING DRIVE OF PUMP SYSTEM

(71) Applicant: MINEBEA MITSUMI INC., Nagano (JP)

(72) Inventors: Yuta Yoshii, Tokyo (JP); Chikara Sekiguchi, Tokyo (JP); Shigenori Inamoto, Tokyo (JP); Yuki Takahashi, Tokyo (JP); Daisuke Kodama, Tokyo (JP); Daisuke Kurita, Nagano (JP)

(73) Assignee: MINEBEA MITSUMI INC., Nagano (JP)

( * ) Notice: Subject to any disclaimer, the term of this patent is extended or adjusted under 35 U.S.C. 154(b) by 0 days.

(21) Appl. No.: 17/645,270

(22) Filed: Dec. 20, 2021

(65) Prior Publication Data

US 2022/0213887 A1 Jul. 7, 2022

(30) Foreign Application Priority Data

Dec. 25, 2020 (JP) ..... 2020-218021

(51) Int. Cl.
*F04B 49/06* (2006.01)
*F04B 17/03* (2006.01)

(52) U.S. Cl.
CPC ..... *F04B 49/06* (2013.01); *F04B 17/03* (2013.01); *F04B 2203/0202* (2013.01); *F04B 2205/06* (2013.01)

(58) Field of Classification Search
CPC .. F04B 49/06; F04B 17/03; F04B 2203/0202; F04B 2205/06
See application file for complete search history.

(56) References Cited

U.S. PATENT DOCUMENTS

2004/0033140 A1* 2/2004 Jensen ..... G05D 7/0676 417/1
2010/0181867 A1* 7/2010 Inoue ..... F04B 43/046 318/116
2013/0196242 A1* 8/2013 Hatano ..... F04B 43/04 429/444
2014/0023533 A1* 1/2014 Ishii ..... F04B 45/043 417/413.1
2015/0094602 A1* 4/2015 Yamashita ..... A61B 5/02141 600/494
2015/0150470 A1* 6/2015 Sano ..... A61B 5/0225 600/490

FOREIGN PATENT DOCUMENTS

EP 2740936 B1 9/2016
JP H0216379 A 1/1990
(Continued)

*Primary Examiner* — Connor J Tremarche
(74) *Attorney, Agent, or Firm* — McCoy Russell LLP

(57) ABSTRACT

A pump system contains a vibration actuator which can be electromagnetically driven by applying an alternating-current voltage E thereto, a sealed chamber connected to a suction port and a discharge port, and a movable wall for changing a volume of the sealed chamber. The movable wall is displaced due to drive of the vibration actuator to supply fluid in the sealed chamber into a target object. The pump system controls an effective value of the alternating-current voltage E so that an amplitude Y of the vibration actuator is constant.

5 Claims, 9 Drawing Sheets

(56) References Cited

FOREIGN PATENT DOCUMENTS

| | | | |
|---|---|---|---|
| JP | 2001342966 | A | 12/2001 |
| JP | 2002031078 | A | 1/2002 |
| JP | 2004011597 | A | 1/2004 |
| JP | 2015169101 | A | 9/2015 |
| WO | 2009031543 | A1 | 3/2009 |

* cited by examiner

PUMP SYSTEM, FLUID SUPPLY DEVICE AND METHOD FOR CONTROLLING DRIVE OF PUMP SYSTEM

CROSS-REFERENCE TO RELATED APPLICATION

The present application claims priority to Japanese Patent Application No. 2020-218021 filed on Dec. 25, 2020. The entire contents of the above-listed application is hereby incorporated by reference for all purposes.

TECHNICAL FIELD

The present disclosure relates to a pump system, a fluid supply device and a method of controlling drive of the pump system.

BACKGROUND

For example, patent document 1 discloses a water supply device. In the water supply device of the patent document 1, an optimum value of a rotational frequency of a motor pump changes according to pressure applied to water to be supplied. Thus, it is necessary to adjust a voltage supplied to the motor pump so that the rotational frequency of the motor pump is set at the optimum value for each value of the pressure. Further, patent document 2 discloses a pump control device. The pump control device of the patent document 2 predicts a rotational frequency required for providing a predetermined flow rate based on measurement of a pump performance performed in advance and a measurement result of the pump performance in a state that the pump is attached to a pipe or the like. Further, the pump control device of the patent document 2 calculates and outputs a voltage required for allowing the pump to drive with the required rotational frequency. Patent document 3 discloses a pump unit. The pump unit of the patent document 3 includes two pump portions having different volumes. The pump unit of the patent document 3 can provide either one of a high-pressure mode and a high flow rate mode with a small motor by switching the pump portions according to a pressure state.

RELATED ART DOCUMENTS

Patent Documents

JP 2002-031078A
JP 2001-342966A
JP 2004-011597A

SUMMARY

Problems to be Solved by the Invention

However, the rotational frequency of the motor pump of the patent document 1 changes according to the supplied voltage and a change of the rotational frequency results in an abnormal noise, a fault and the like caused by a resonance phenomenon of the water supply device. Thus, it is necessary to address the abnormal noise, the fault and the like. Thus, the water supply device should have a complicated configuration. The pump control device of the patent document 2 needs to perform a plurality of calculations to calculate and output the required voltage. Thus, the configuration of the pump control device, particularly, the circuit configuration should be complicated. Further, the pump unit of the patent document 3 needs the plurality of pump portions and a mechanism for switching the pump portions. As a result, a size of the pump unit increases and the configuration of the pump unit becomes complicated.

The present disclosure has been made in view of the above-described problems of the conventional arts. Accordingly, it is an object of the present disclosure to provide a pump system which has a superior flow characteristic with a simple configuration, a fluid supply device containing the pump system and a method for controlling drive of the pump system.

Means for Solving the Problems

The above object is achieved by the present disclosures defined in the following (1) to (7).

(1) A pump system, comprising:

a vibration actuator which can be electromagnetically driven by applying an alternating-current voltage thereto;

a sealed chamber connected to a suction port and a discharge port; and a movable wall for changing a volume of the sealed chamber, wherein the movable wall is displaced due to drive of the vibration actuator to supply fluid in the sealed chamber into a target object, and wherein an effective value of the alternating-current voltage is controlled so that an amplitude of the vibration actuator is constant.

(2) The pump system according to the above (1), wherein the effective value is controlled by changing an amplitude of the alternating-current voltage.

(3) The pump system according to the above (1), wherein the alternating-current voltage is a rectangular wave, and wherein the effective value is controlled by changing at least one of an amplitude and a duty ratio of the alternating-current voltage.

(4) The pump system according to any one of the above (1) to (3), wherein the pump system is configured to detect pressure in the target object to control the effective value based on the detected pressure.

(5) The pump system according to any one of the above (1) to (4), wherein the vibration actuator has a resonance frequency which changes according to pressure in the target object.

(6) A fluid supply device, comprising:

the pump system defined by any one of the above (1) to (5).

(7) A method for controlling drive of a pump system containing a vibration actuator which can be electromagnetically driven by applying an alternating-current voltage thereto, a sealed chamber connected to a suction port and a discharge port, and a movable wall for changing a volume of the sealed chamber, wherein the movable wall is displaced due to drive of the vibration actuator to supply fluid in the sealed chamber into a target object, the method comprising:

controlling an effective value of the alternating-current voltage so that an amplitude of the vibration actuator is constant.

Effects of the Invention

The pump system of the present disclosure controls the effective value of the alternating-current (AC) voltage so that the amplitude of the vibration actuator is constant.

Therefore, it is possible to prevent the amplitude from reducing when the pressure in the target object increases, and thereby it is possible to provide the pump system which has a superior flow characteristic.

The fluid supply device of the present disclosure contains the above-described pump system. Therefore, the fluid supply device can also receive the effect of the pump system, and thereby it is possible to provide the fluid supply device which has the superior flow characteristic.

The method for controlling the drive of the pump system of the present disclosure contains controlling the effective value of the alternating-current (AC) voltage so that the amplitude of the vibration actuator is constant. Therefore, it is possible to prevent the amplitude from reducing when the pressure in the target object increases, and thereby it is possible to allow the pump system to have the superior flow characteristic.

DETAILED DESCRIPTION

Hereinafter, a pump system, a fluid supply device and a method of controlling drive of the pump system of the present disclosure will be described in detail with reference to a preferred embodiment shown in the accompanying drawings.

Figure 1:
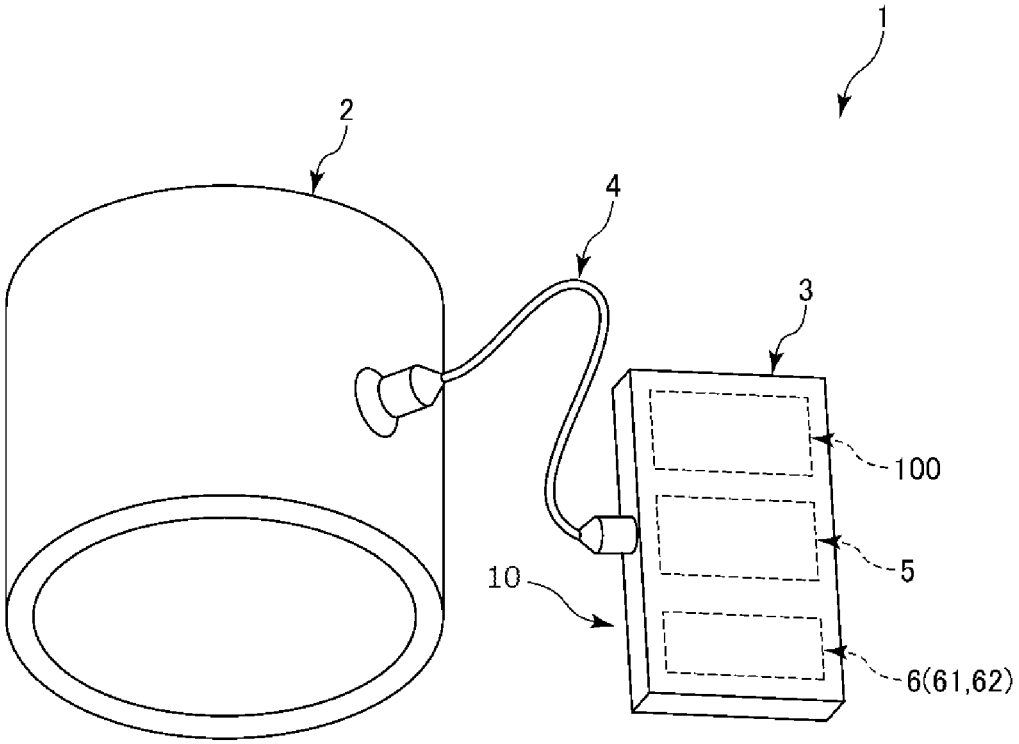
FIG. 1 is a perspective view showing an overall configuration of an electronic sphygmomanometer according to a preferred embodiment.
Figure 2:
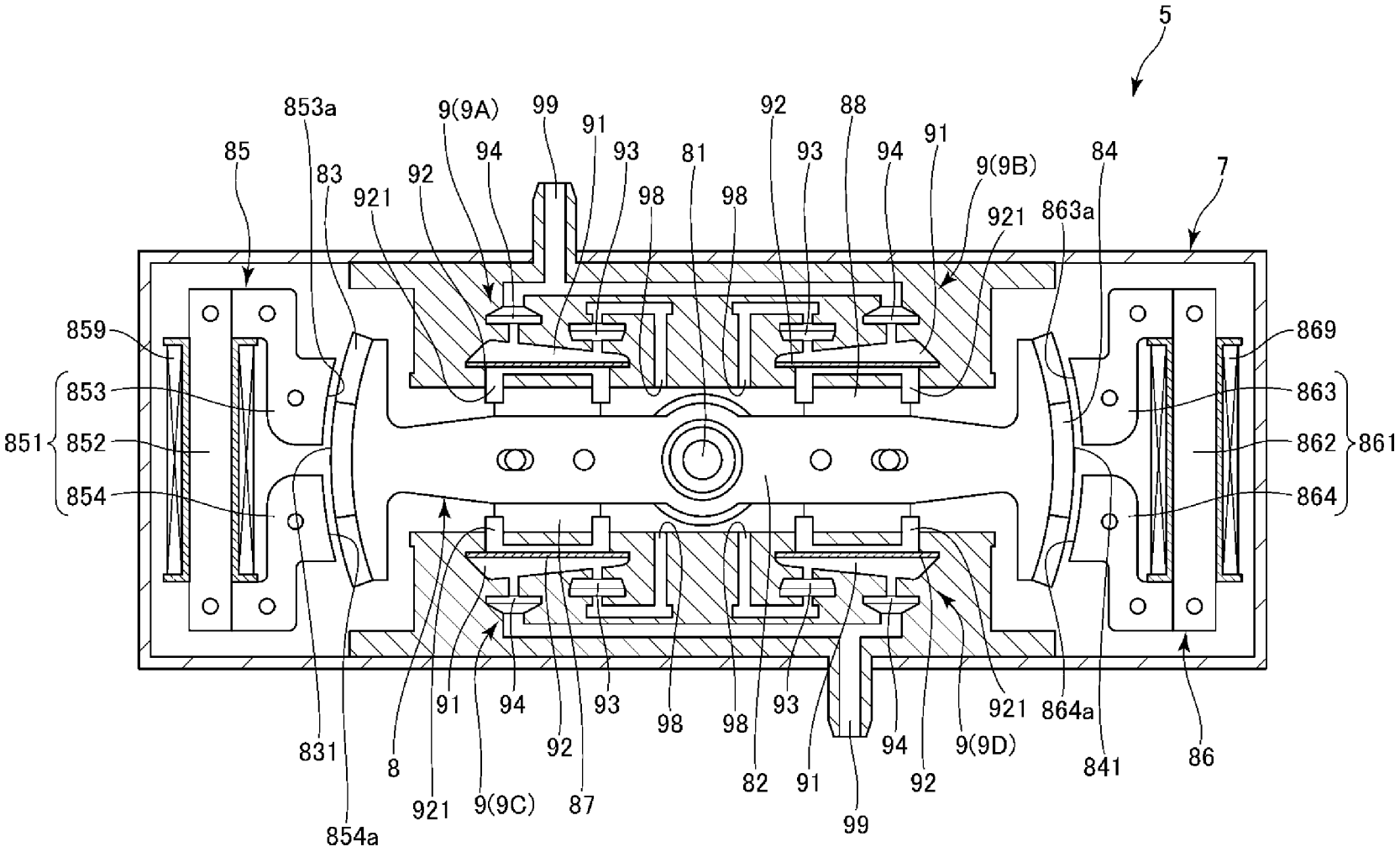
FIG. 2 is a cross-sectional view of a pump.
Figure 3:
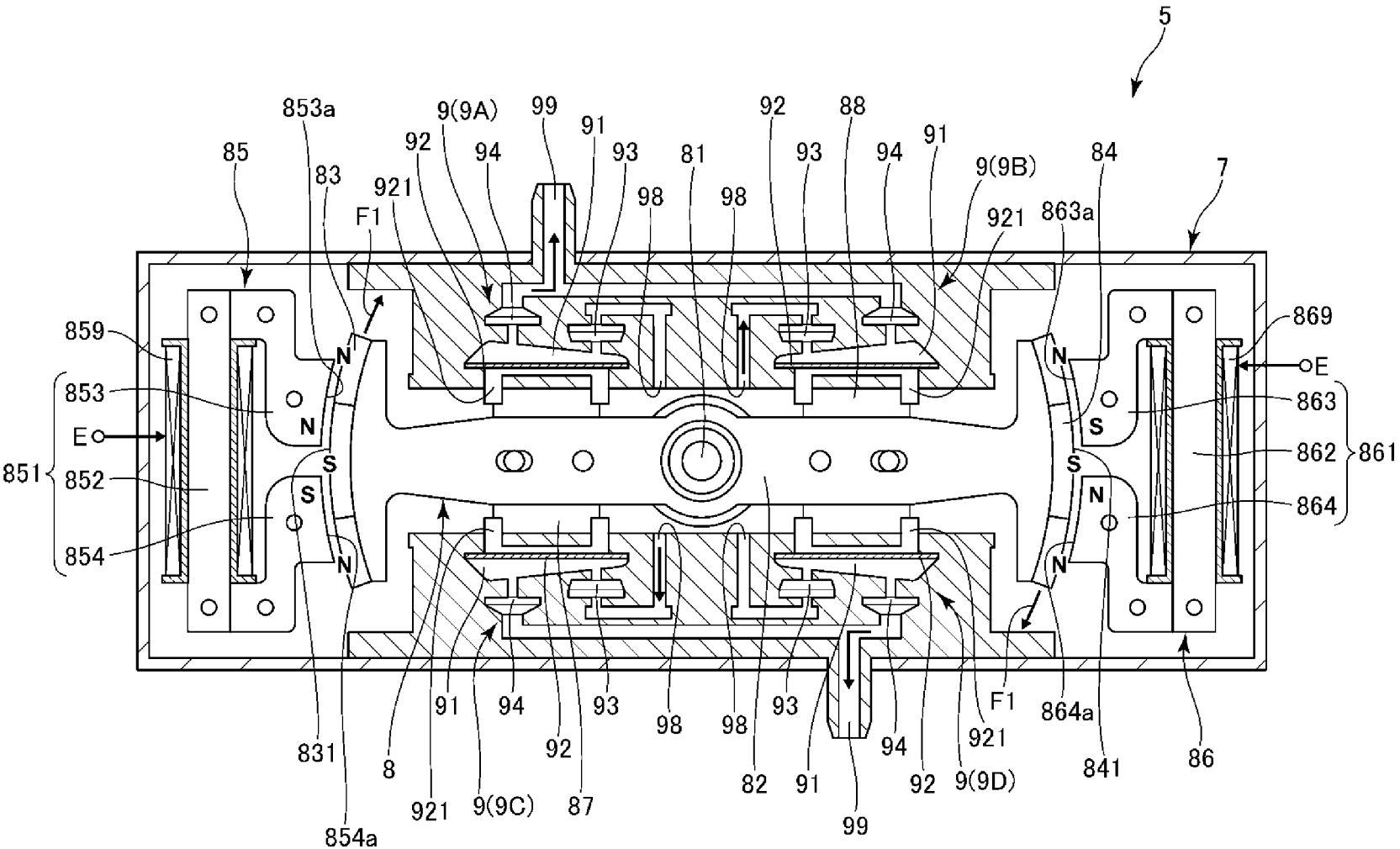
FIG. 3 is a cross-sectional view showing a driving principle of the pump shown in FIG. 2.
Figure 4:
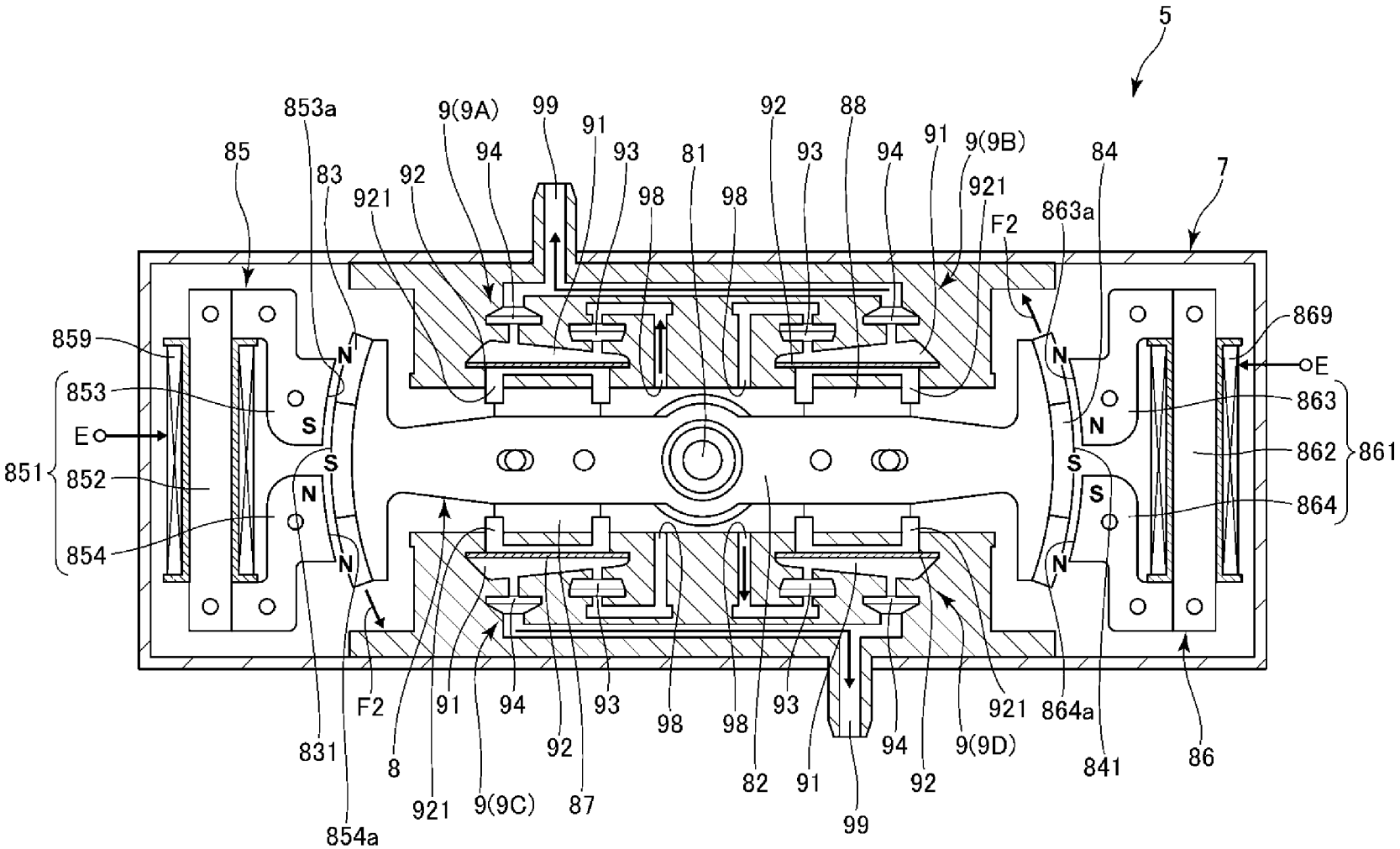
FIG. 4 is another cross-sectional view showing the driving principle of the pump shown in FIG. 2.
Figure 5:
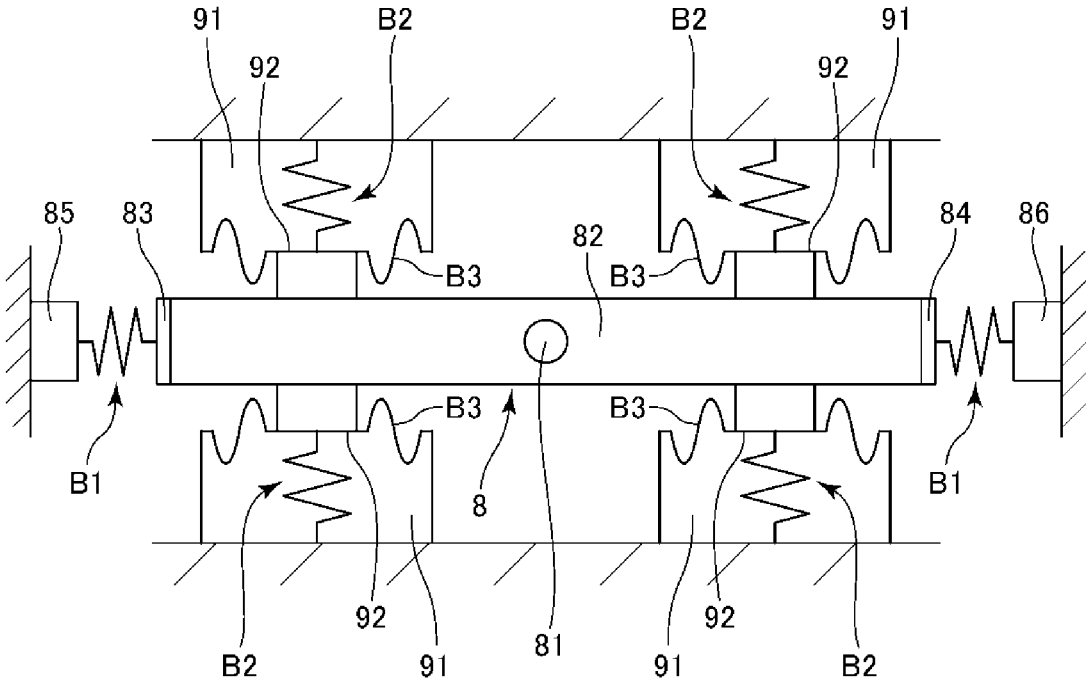
FIG. 5 is a schematic diagram showing a spring system of a vibration actuator.
Figure 6:
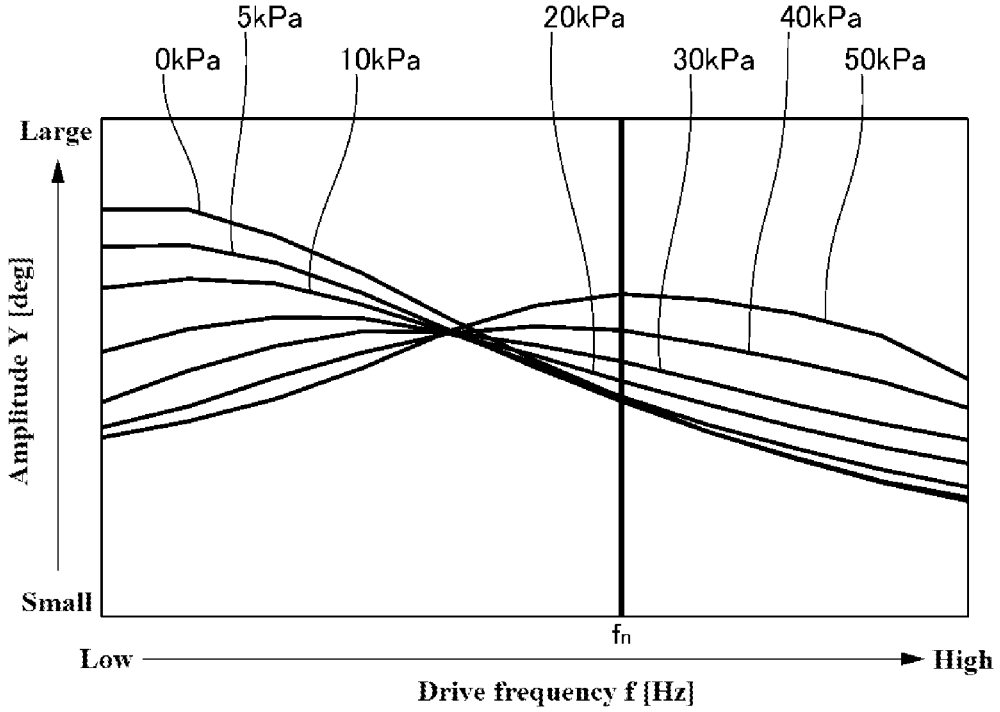
FIG. 6 is a graph showing a relationship between a drive frequency and an amplitude.
Figure 7:
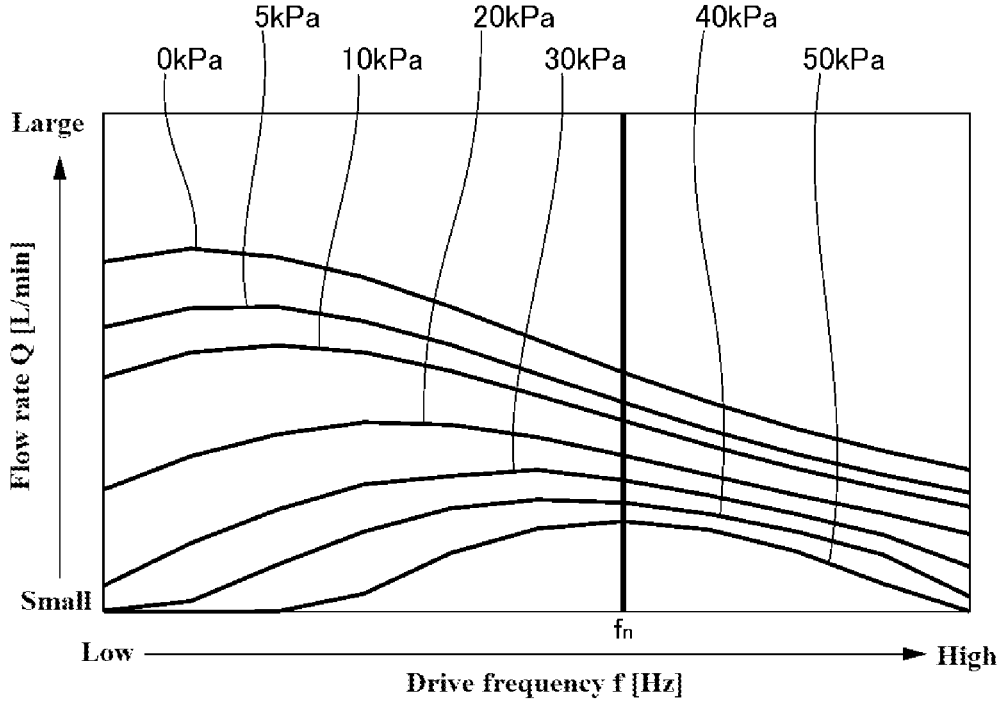
FIG. 7 is a graph showing a relationship between the drive frequency and a flow rate.
Figure 8:
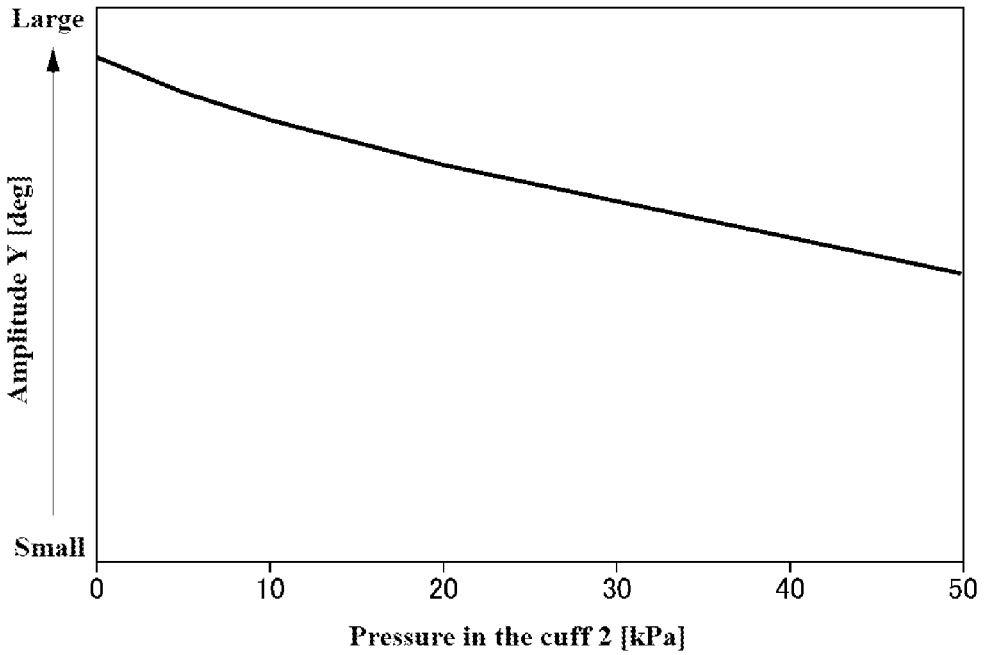
FIG. 8 is a graph showing a relationship between pressure in a sealed chamber and the amplitude.
Figure 9:
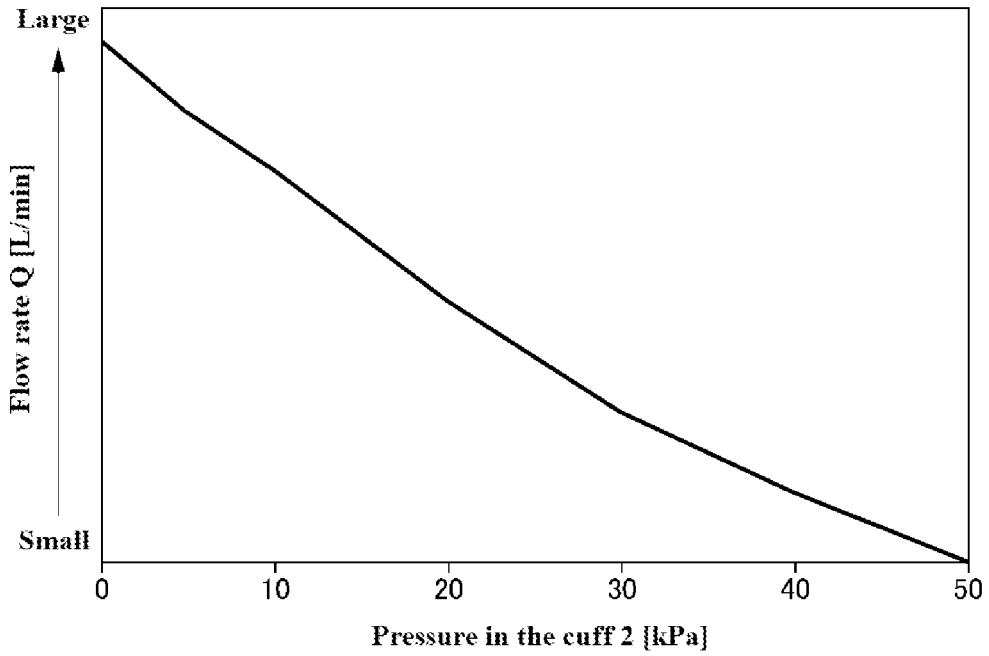
FIG. 9 is a graph showing a relationship between the pressure in the sealed chamber and the flow rate.
Figure 10:
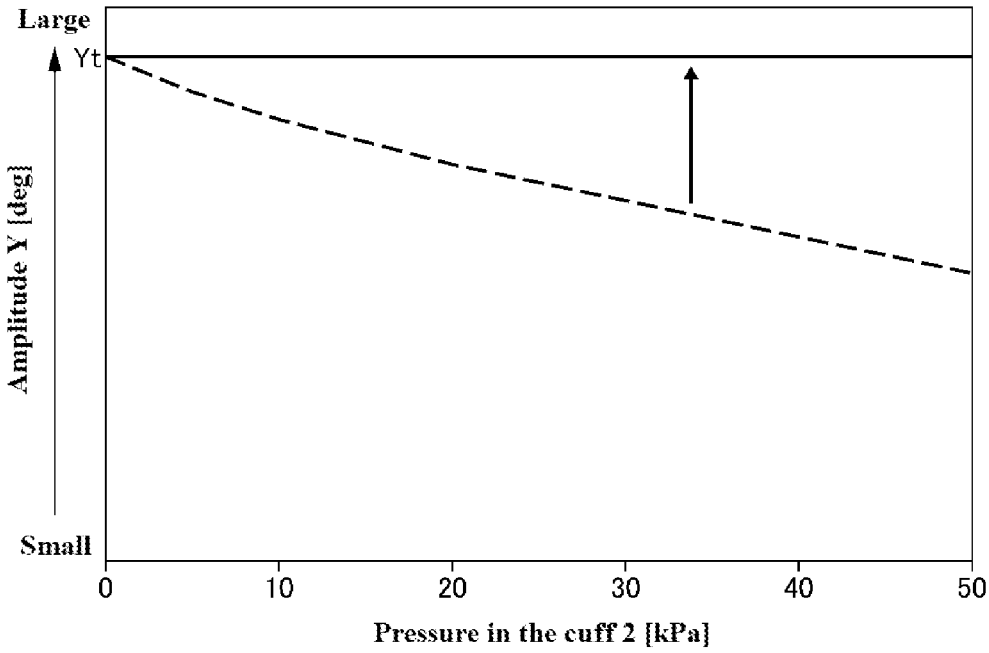
FIG. 10 is another graph showing the relationship between the pressure in the sealed chamber and the amplitude.
Figure 11:
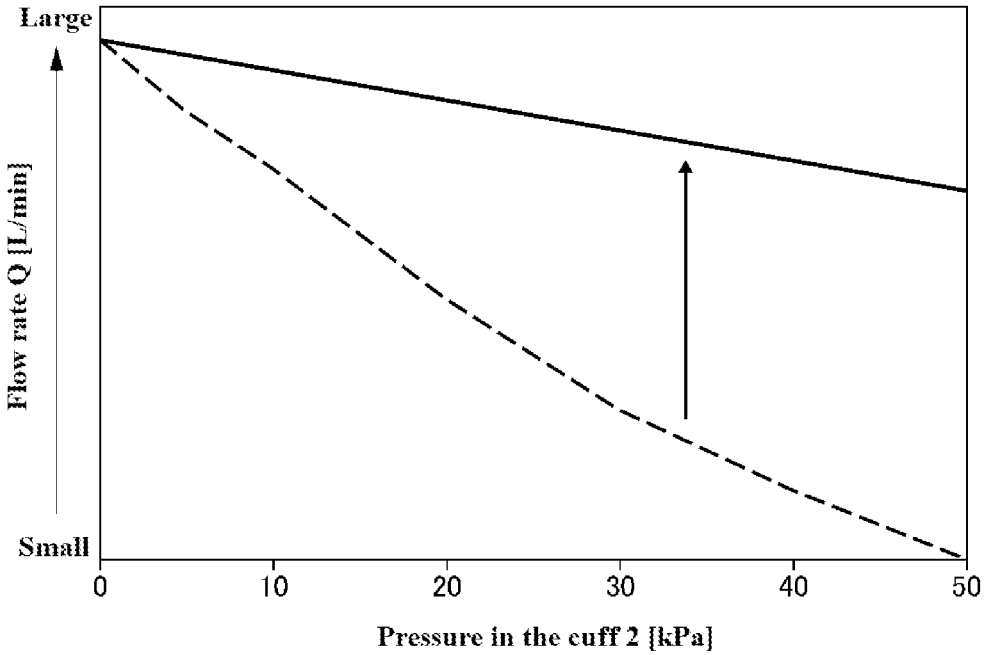
FIG. 11 is another graph showing the relationship between the pressure in the sealed chamber and the flow rate.

FIG. 1 is a perspective view showing an overall configuration of an electronic sphygmomanometer according to the preferred embodiment. FIG. 2 is a cross-sectional view of a pump. FIG. 3 is a cross-sectional view showing a driving principle of the pump shown in FIG. 2. FIG. 4 is another cross-sectional view showing the driving principle of the pump shown in FIG. 2. FIG. 5 is a schematic diagram showing a spring system of a vibration actuator. FIG. 6 is a graph showing a relationship between a drive frequency and an amplitude. FIG. 7 is a graph showing a relationship between the drive frequency and a flow rate. FIG. 8 is a graph showing a relationship between pressure in a sealed chamber and the amplitude. FIG. 9 is a graph showing a relationship between the pressure in the sealed chamber and the flow rate. FIG. 10 is another graph showing the relationship between the pressure in the sealed chamber and the amplitude. FIG. 11 is another graph showing the relationship between the pressure in the sealed chamber and the flow rate. FIGS. 12 to 15 are diagrams showing examples of a waveform of an alternating-current (AC) voltage. In the following description, an upper side of the paper on which each of FIGS. 2 to 4 is illustrated is sometimes referred to as "an upper side" and a lower side of the paper on which each of FIGS. 2 to 4 is illustrated is sometimes referred to as "a lower side" for convenience of explanation.

FIG. 1 shows an electronic sphygmomanometer 1 serving as a fluid supply device. The electronic sphygmomanometer 1 includes a cuff 2, a main body 3 and a tube 4 for connecting between the cuff 2 and the main body 3 to supply and discharge fluid. The cuff 2 is attached to a measurement target part such as an arm of a user. The cuff 2 has a bladder provided therein. The bladder is inflated when the fluid is supplied from the main body 3 into the bladder to compress the measurement target part. The main body 3 measures pressure in the cuff (target object) 2 to calculate a blood pressure value of the user based on a measurement result. The fluid to be supplied from the main body 3 into the bladder is not particularly limited. Although the fluid may be liquid or gas, it is preferable that the fluid is the gas. For convenience of explanation, the following description will be given with assuming that the fluid is air.

When blood pressure is measured according to the general oscillometric method, the following procedure is performed. First, the cuff 2 is wound onto the measurement target part of the user. At the time of measuring the blood pressure, the air is supplied from the main body 3 into the cuff 2 to make the pressure in the cuff 2 (referred to as "cuff pressure") higher than a maximum blood pressure of the user. After that, the pressure in the cuff 2 is gradually reduced. During this process, the main body 3 detects the pressure in the cuff 2 to obtain a variation of an arterial volume occurring in an artery of the measurement target part as a pulse wave signal. The maximum blood pressure (systolic blood pressure) and a minimum blood pressure (diastolic blood pressure) of the user are calculated based on a change of an amplitude of the pulse wave signal caused by a change of the cuff pressure. More specifically, the maximum blood pressure (systolic blood pressure) and the minimum blood pressure (diastolic blood pressure) of the user are mainly calculated based on a rising edge and a falling edge of the pulse wave signal. However, the blood pressure measurement method is not particularly limited thereto. For example, it is possible to use the Riva-Rocci Korotkoff method commonly used in conjunction with the oscillometric method.

As shown in FIG. 1, the main body 3 contains a pressure sensor 100 therein. The pressure sensor 100 has a function of detecting the pressure in the cuff 2. The main body 3 further contains a pump system 10 therein. The pump system 10 includes a pump 5 for supplying the air into the cuff 2 and a control device 6 for calculating (detecting) the pressure in the cuff 2 based on an output signal from the pressure sensor 100 to control drive of the pump 5 based on the calculated pressure in the cuff 2.

As shown in FIG. 2, the pump 5 has a housing 7, a vibration actuator 8 and four pump units 9.

The vibration actuator 8 includes a shaft portion 81, a movable body 82 supported by the shaft portion 81 so as to be movable with respect to the housing 7 and a pair of coil core portions 85, 86 fixed to the housing 7.

The movable body 82 has an elongated shape. The movable body 82 is connected to the housing 7 so that a center portion of the movable body 82 is supported by the shaft portion 81. Thus, the movable body 82 can perform reciprocating rotation with respect to the housing 7 around the shaft portion 81 like a seesaw.

Magnets 83, 84 are respectively provided at both end portions of the movable body 82. The magnets 83, 84 are disposed so as to be symmetrical with each other across the shaft portion 81. The magnets 83, 84 respectively have arc-shaped magnetic pole faces 831, 841 respectively facing the coil core portions 85, 86. S poles and N poles are alternately arranged on each of the magnetic pole faces 831, 841 along its arc direction. Each of the magnets 83, 84 is a permanent magnet and composed of an Nd sintered magnet or the like.

Pushers 87, 88 are provided on the movable body 82 for pushing the pump units 9 when the movable body 82 performs the reciprocating rotation. The pushers 87, 88 are disposed so as to be symmetrically with each other across the shaft portion 81. The pusher 87 is disposed between the shaft portion 81 and the magnet 83 so as to protrude toward both sides in a width direction of the movable body 82 (both sides in the vertical direction in FIG. 2). Further, the pusher 88 is disposed between the shaft portion 81 and the magnet 84 so as to protrude toward both sides in the width direction of the movable body 82 (both sides in the vertical direction in FIG. 2).

The coil core portions 85, 86 are respectively disposed on both sides of the movable body 82. The coil core portion 85 faces the magnetic pole face 831 of the magnet 83. The coil core portion 86 faces the magnetic pole face 841 of the magnet 84. The coil core portions 85, 86 are disposed so as to be symmetrical with each other across the shaft portion 81.

The coil core portion 85 includes a core portion 851 and a coil 859 wound around the core portion 851. The core portion 851 has a core 852 around which the coil 859 is wound and a pair of core magnetic poles 853, 854 respectively extending from both ends of the core 852. The core magnetic poles 853, 854 respectively have magnetic pole faces 853*a*, 854*a* facing the magnetic pole face 831 of the magnet 83. Each of the magnetic pole faces 853*a*, 854*a* is curved in an arc shape so as to correspond to a shape of the magnetic pole face 831 of the magnet 83. The coil 859 is connected to the control device 6. When an AC (alternating-current) voltage E is applied to the coil 859 from the control device 6, the core magnetic poles 853, 854 are excited.

The coil core portion 86 includes a core portion 861 and a coil 869 wound around the core portion 861. The core portion 861 has a core 862 around which the coil 869 is wound and a pair of core magnetic poles 863, 864 respectively extending from both ends of the core 862. The core magnetic poles 863, 864 respectively have magnetic pole faces 863*a*, 864*a* facing the magnetic pole face 841 of the magnet 84. Each of the magnetic pole faces 863*a*, 864*a* is curved in an arc shape so as to correspond to a shape of the magnetic pole face 841 of the magnet 84. The coil 869 is connected to the control device 6. When the AC voltage E is applied to the coil 869 from the control device 6, the core magnetic poles 863, 864 are excited.

The core portions 851, 861 are respectively magnetic material which can be respectively excited by supplying the electric power to the coils 859, 869. For example, each of the core portions 851, 861 can be formed from electromagnetic stainless steel, sintered material, MIM (metal injection mold) material, a laminated steel sheet, an electrogalvanized steel sheet (SECC) or the like.

The four pump units 9 are respectively disposed on an upper left side, an upper right side, a lower left side and a lower right side of the shaft portion 81. Specifically, two of the pump units 9 are disposed so as to face each other in the vertical direction across the pusher 87. Further, remaining two of the pump units 9 are disposed so as to face each other in the vertical direction across the pusher 88. The four pump units 9 have the same configuration as each other. Each of the pump units 9 has a sealed chamber 91 and a movable wall 92.

The sealed chamber 91 is connected to a suction port 98 for sucking the air from the outside into the sealed chamber 91 and a discharge port 99 for discharging the air in the sealed chamber 91 toward the outside. In the present embodiment, two of the sealed chambers 91 located on the upper side of the movable body 82 share one discharge port 99. Remaining two of the sealed chambers 91 located on the lower side of the movable body 82 share another discharge port 99.

The movable wall 92 constitutes a part of the sealed chamber 91. The movable wall 92 can be displaced to change a volume in the sealed chamber 91 when the movable wall 92 is pushed by the pusher 87 or 88. When the volume in the sealed chamber 91 reduces due to displacement of the movable wall 92, the air in the sealed chamber 91 is discharged from the discharge port 99. On the other hand, when the volume in the sealed chamber 91 increases due to the displacement of the movable wall 92, the air flows into the sealed chamber 91 through the suction port 98. When the above-mentioned reduction and increase of the volume in each of the sealed chambers 91 are repeated, the air is continuously discharged from the discharge ports 99. The movable walls 92 may be a diaphragm, for example. The movable wall 92 can be formed from elastically deformable material. Each of the movable walls 92 has an insertion portion 921 into which the pusher 87 or 88 should be inserted. Each of the movable walls 92 is connected to the pusher 87 or 88 through the insertion portion 921.

Valves 93 are respectively provided between the sealed chambers 91 and the suction ports 98. Each of the valves 93 allows the air to be suctioned into each of the sealed chambers 91 through the suction port 98 and prevents the air from being discharged from each of the sealed chambers 91 through the suction port 98. Further, valves 94 are respectively provided between the sealed chambers 91 and the discharge ports 99. Each of the valves 94 allows the air to be discharged from each of the sealed chambers 91 through the discharge port 99 and prevents the air from being suctioned into each of the sealed chambers 91 through the discharge port 99. With this configuration, it is possible to more reliably and more efficiently perform the suction and the discharge of the air.

As shown in FIG. 1, the control device 6 has a drive control unit 61 for controlling the drive of the vibration actuator 8 and a pressure detection unit 62 for detecting the pressure in the cuff 2 based on the output signal from the pressure sensor 100. The drive control unit 61 is configured to control the drive of the vibration actuator 8 based on the pressure in the cuff 2 detected by the pressure detection unit 62. The control device 6 is composed of a computer or the like. The control device 6 has a processor (CPU) for processing information, a memory communicatively connected to the processor and an external interface. In addition, the memory stores various programs which can be executed by the processor and the processor can read and execute the various programs or the like stored in the memory.

The configuration of the electronic sphygmomanometer 1 has been described. Next, the drive of the pump 5 will be described. In the following description, the four pump units 9 are distinguished from each other by labeling them as the "pump unit 9A", the "pump unit 9B", the "pump unit 9C" and the "pump unit 9D" for convenience of explanation.

When the AC voltage E is applied from the drive control unit 61 to the coils 859, 869, the pump 5 is driven by repeatedly alternating between a first state in which the movable body 82 rotates toward one direction as shown in FIG. 3 and a second state in which the movable body 82 rotates toward another direction as shown in FIG. 4. In the first state shown in FIG. 3, the core magnetic poles 853, 864 are excited with the N pole and the core magnetic poles 854, 863 are excited with the S pole. Conversely, in the second state shown in FIG. 4, the core magnetic poles 853, 864 are excited with the S pole and the core magnetic poles 854, 863 are excited with the N pole.

In the first state, torque F1 directed toward an arrow direction illustrated in FIG. 3 is generated by magnetic force (attractive force and repulsive force) acting between the magnets 83, 84 and the coil core portions 85, 86, and thereby the movable body 82 rotates in the direction of the torque F1. With this movement, the movable walls 92 of the pump units 9A, 9D are respectively pushed by the pushers 87, 88, and thereby the volumes in the sealed chambers 91 of the pump units 9A, 9D are reduced. As a result, the air in the sealed chambers 91 of the pump units 9A, 9D is discharged from the discharge ports 99. Further, the discharged air is supplied into the cuff 2 through the tube 4, and thereby the pressure in the cuff 2 increases. On the other hand, since the volumes in the sealed chambers 91 of the pump units 9B, 9C increase, the air flows into the sealed chambers 91 of the pump units 9B, 9C through the suction ports 98.

In the second state, torque F2 directed toward a direction opposite to the direction of the torque F1 is generated by the magnetic force (attractive force and repulsive force) acting between the magnets 83, 84 and the coil core portions 85, 86, and thereby the movable body 82 rotates in the direction of the torque F2. With this movement, the movable walls 92 of the pump units 9B, 9C are respectively pushed by the pushers 87, 88, and thereby the volumes in the sealed chambers 91 of the pump unit 9B, 9C are reduced. As a result, the air in the sealed chambers 91 of the pump unit 9B, 9C is discharged from the discharge ports 99. Further, the discharged air is supplied into the cuff 2 through the tube 4, and thereby the pressure in the cuff 2 increases. On the other hand, since the volumes in the sealed chambers 91 of the pump units 9A, 9D increase, the air flows into the sealed chambers 91 of the pump units 9A, 9D through the suction ports 98.

As described above, when the pump 5 repeatedly alternates between the first state and the second state, it is possible to repeatedly alternate the state in which the air is discharged from the pump units 9A, 9D and the state in which the air is discharged from the pump units 9B, 9C. As a result, the air can be continuously discharged from the pump 5. Therefore, it is possible to efficiently supply the air into the cuff 2 and smoothly increase the pressure in the cuff 2.

The drive of the pump 5 has been explained in the above description. Next, a driving principle of the pump 5 will be explained. The vibration actuator 8 is driven according to a motion equation expressed by the following equation (1) and a circuit equation expressed by the following equation (2).

[Equation 1]

$$J\frac{d^2\theta(t)}{dt^2} = K_t i(t) - K_{sp}\theta(t) - D\frac{d\theta(t)}{dt} \tag{1}$$

J: Inertial moment [Kg*m$^2$]
θ(t): Displacement angle [rad]
$K_t$: Torque constant [Nm/A]
i(t): Current [A]
$K_{sp}$: Spring constant [N/m]
D: Damping coefficient [Nm/(rad/s)]

[Equation 2]

$$e(t) = Ri(t) + L\frac{di(t)}{dt} + K_e\frac{dx(t)}{dt} \tag{2}$$

e(t): Voltage [V]
R: Resistance [Ω]
L: Inductance [H]
$K_e$: Counter-electromotive force constant [V/(m/s)]

As described above, the inertial moment J [Kg*m$^2$], the displacement angle (rotational angle) θ(t) [rad], the torque constant $K_t$[Nm/A], the current i(t) [A], the spring constant $K_{sp}$[N/m], the damping coefficient D [Nm/(rad/s)] and the like of the movable body 82 can be appropriately set as long as they satisfy the equation (1). Similarly, the voltage e(t) [V], the resistance R [Ω], the inductance L [H] and the counter-electromotive force constant $K_e$[V/(m/s)] can be appropriately set as long as they satisfy the equation (2).

Further, a flow rate of the pump 5 is determined by the following equation (3) and pressure of the pump 5 is determined by the following equation (4).

[Equation 3]

$$Q = Axf*60 \tag{3}$$

Q: Flow rate [L/min]
A: Piston area [m$^2$]
x: Piston displacement [m]
f: Drive frequency [Hz]

[Equation 4]

$$P = P_0\left(\frac{V+\Delta V}{V-\Delta V} - 1\right) \tag{4}$$

P: Increased pressure [kPa]
$P_0$: Atmospheric pressure [kPa]
V: Sealed chamber volume [m$^3$]
ΔV: Changed volume [m$^3$]
ΔV=Ax
A: Piston area [m$^2$]
x: Piston displacement [m]

As described above, the flow rate Q [L/min], the piston area A [m$^2$], the piston displacement x [m], the drive frequency f [Hz] and the like of the pump 5 can be appropriately set as long as they satisfy the equation (3). Similarly, the increased pressure P [kPa], the atmospheric pressure $P_0$ [kPa], the sealed chamber volume V [$m^3$], the changed volume ΔV [$m^3$] and the like can be appropriately set as long as they satisfy the equation (4).

Next, a resonance frequency of the vibration actuator 8 will be explained. As shown in FIG. 5, the vibration actuator 8 has a spring mass system structure for supporting the movable body 82 by magnetic springs B1 formed by the magnetic force acting between the coil core portions 85, 86 and the magnets 83, 84 and air springs (fluid springs) B2 formed by elastic force of compressed air in the sealed chambers 91. Thus, the movable body 82 has a resonant frequency $f_r$ expressed by the following equation (5).

[Equation 5]

$$f_r = \frac{1}{2\pi}\sqrt{\frac{K_{sp}}{J}} \tag{5}$$

$f_r$: Resonance frequency [Hz]

$K_{sp}$: Spring constant [N/m]

J: Inertial moment [kg*$m^2$]

Further, the spring constant $K_{sp}$ can be expressed by a sum of a spring constant $K_{ACT}$ of the vibration actuator 8 itself, which contains the effects of the magnetic springs B1 and elastic force B3 of the movable walls 92, and a spring constant $K_{Air}$ of the air springs B2 as expressed by the following equation (6).

[Equation 6]

$$K_{sp}=K_{ACT}+K_{Air} \tag{6}$$

$K_{ACT}$: Spring constant of vibration actuator itself $K_{Air}$: Spring constant of air spring In the vibration actuator 8, the spring constant $K_{Air}$ of each air spring B2 changes according to the pressure in each sealed chamber 91 (the pressure in the cuff 2) and thus the resonant frequency $f_r$ of the movable body 82 changes according to the change of the spring constant $K_{Air}$ as is clear from the above equations (5) and (6).

Next, description will be given to a change of an amplitude Y of the vibration actuator 8 and a change of the flow rate Q of the air discharged from the pump 5 which are caused by the change of the resonance frequency $f_r$. The following description will be given to a representative example in which the pump 5 can increase the pressure in the cuff 2 up to 50 kPa at the maximum for convenience of explanation. It is noted that the maximum value of the pressure in the cuff 2 is not particularly limited and can be appropriately set so as to meet required conditions. Further, since the cuff 2 is connected to the sealed chambers 91 through the tube 4 as described above, the pressure in the cuff 2 is equal to the pressure in each sealed chamber 91. Thus, the meaning of the "pressure in the sealed chamber(s) 91" and the meaning of the "pressure in the cuff 2" are synonymous with each other.

FIG. 6 shows a relationship between the drive frequency f and the amplitude Y when the pressure in the cuff 2 falls within the range between 0 kPa to 50 kPa. Further, FIG. 7 shows a relationship between the drive frequency f and the flow rate Q when the pressure in the cuff 2 falls within the range between 0 kPa to 50 kPa. The drive frequency f is a frequency of the AC voltage E. Further, in FIGS. 6 and 7, a voltage value and a waveform of the AC voltage E are constant and only the drive frequency f is changed. In FIG. 6, the resonance frequency $f_r$ at each pressure substantially coincides with a value of the drive frequency f at which the amplitude Y becomes the largest. Further, in FIG. 7, the resonance frequency $f_r$ at each pressure substantially coincides with a value of the drive frequency f at which the flow rate Q becomes the largest. As is also clear from FIGS. 6 and 7, it should be understood that the resonant frequency $f_r$ changes according to the pressure in the cuff 2. However, it should be noted that the relationships shown in FIGS. 6 and 7 are merely examples and thus the present disclosure is not necessarily limited to these relationships.

FIG. 8 shows a relationship between internal pressure of the sealed chamber 91 and the amplitude Y when the drive frequency f is set to a frequency $f_n$ ($f=f_n$). Further, FIG. 9 shows a relationship between the internal pressure of the sealed chamber 91 and the flow rate Q of the sealed chamber 91 when the drive frequency f is set to the frequency $f_n$ ($f=f_n$). As is clear from FIGS. 8 and 9, the amplitude Y changes according to the pressure in the cuff 2 and the flow rate Q changes according to the change of the amplitude Y which is caused by the change of the pressure in the cuff 2. Specifically, the amplitude Y reduces as the pressure in the cuff 2 increases and the flow rate Q also reduces together with the reduction of the amplitude Y. This indicates the following two phenomena caused while the resonance frequency $f_r$ is shifted to the higher side due to the increase of the pressure in the cuff 2. One of the two phenomena is that the amplitude Y increases and the flow rate Q also increases as the drive frequency f approaches the resonance frequency $f_r$. The other one of the two phenomena is that the amplitude Y reduces and the flow rate Q also reduces as the drive frequency f moves away from the resonance frequency $f_r$, on the contrary.

When the flow rate Q reduces as the pressure in the cuff 2 increases as described above, the flow rate Q is not stabilized and thus it becomes impossible to supply a sufficient amount of air into the cuff 2 in a high-pressure region. Thus, the pressure in the cuff 2 cannot be smoothly increased. As described above, the method of applying the constant AC voltage E whose effective value is not changed regardless of the pressure in the cuff 2 cannot allow the pump 5 to have a superior flow characteristic.

On the other hand, if it is possible to suppress the reduction of the amplitude Y caused when the pressure in the cuff 2 increases and allow the vibration actuator 8 to always vibrates with the amplitude Y which is sufficiently large when the pressure in the cuff 2 falls within the range between 0 kPa and 50 kPa, it becomes possible to suppress the above-mentioned reduction of the flow rate Q and stabilize the flow rate Q. As a result, it becomes possible to supply the sufficient amount of air into the cuff 2 even in the high-pressure region. Therefore, in the present embodiment, the effective value of the AC voltage E is controlled so that the amplitude Y is kept to be sufficiently large when the pressure in the cuff 2 takes any value in the range between 0 kPa to 50 kPa. Hereinafter, description will be given to this control method.

First, it is noted that the control method is premised on that the drive frequency f is constant (the drive frequency f does not change) during the drive of the pump 5. Although the drive frequency f is not particularly limited to a specific value, the drive frequency f can be determined as follows, for example. As described above, the amplitude Y increases and the flow rate Q also increases as the drive frequency f approaches the resonance frequency $f_r$. Further, a drive mode of the pump 5 approaches resonance drive as the drive frequency f approaches the resonance frequency $f_r$. The resonance drive can allow the vibration actuator 8 to perform power saving drive. Thus, it is preferable to set the drive frequency f to a frequency located between a minimum value and a maximum value of the resonance frequency $f_r$ when the pressure in the cuff 2 falls within the range between 0 kPa and 50 kPa. Namely, in the example shown in FIGS. 6 and 7, it is preferable to set the drive frequency f to a frequency located between the resonance frequency $f_r$ when the pressure in the cuff 2 is 0 kPa and the resonance frequency $f_r$ when the pressure in the cuff 2 is 50 kPa. By setting the drive frequency f according to the above-mentioned concept, it is possible to suppress a difference between the drive frequency f and the resonance frequency $f_r$ when the pressure in the cuff 2 falls within the range between 0 kPa and 50 kPa to be small, and thereby the above-described effects can be easily obtained. For this reason, the drive frequency f is set to the frequency $f_n$ located within the range between the resonance frequency $f_r$ when the pressure in the cuff 2 is 0 kPa and the resonance frequency $f_r$ when the pressure in the cuff 2 is 50 kPa ($f=f_n$).

The drive control unit 61 stores a target amplitude $Y_t$ which is a target value of the amplitude Y. Although the target amplitude $Y_t$ is not particularly limited to a specific value, it is preferable that the target amplitude $Y_t$ is larger. By setting the target amplitude $Y_t$ as large as possible, a larger flow rate Q can be provided and thus it is possible to improve the flow rate characteristic of the pump 5. The target amplitude $Y_t$ may be set with keeping a margin for avoiding a risk of failure or the like with respect to a maximum amplitude which can be provided by the vibration actuator 8. For example, the target amplitude $Y_t$ can be set to fall within the range between about 80% to 95% of the maximum amplitude of the vibration actuator 8. By setting the target amplitude $Y_t$ according to the above-mentioned concept, it is possible to sufficiently drive the pump 5 with sufficient power while ensuring the life and the long-term reliability of the pump 5.

The drive control unit 61 has (stores) a control program for keeping the amplitude Y at the target amplitude $Y_t$ when the pressure in the cuff 2 falls within the range between 0 kPa and 50 kPa. The control program is not particularly limited to a specific kind. Examples of the control program contain a table in which values of the pressure in the cuff 2 are respectively associated with effective values of the AC voltage E for allowing the amplitude Y to be the target amplitude $Y_t$ when the pressure in the cuff 2 takes at each value, a calculation formula to which a value of the pressure in the cuff 2 is substituted to calculate an effective value of the AC voltage E for allowing the amplitude Y to be the target amplitude $Y_t$ when the pressure in the cuff 2 takes this value, and the like.

The drive control unit 61 obtains the effective value of the AC voltage E corresponding to the pressure in the cuff 2 detected by the pressure detection unit 62 from the control program as a "target effective value" to control the AC voltage E so that the effective value of the AC voltage E coincides with the obtained target effective value. The control method is not particularly limited to a specific kind. For example, it is possible to use a feedback control method as the control method. In this feedback control method, the AC voltage E is controlled so that an actual effective value of the AC voltage E approaches the target effective value, for instance, the actual effective value of the AC voltage E coincides with the target effective value with comparing the actual effective value of the AC voltage E with the target effective value.

According to the above-described control method, it is possible to keep the amplitude Y at the target amplitude $Y_t$ when the pressure in the cuff 2 falls within the range between 0 kPa and 50 kPa as shown in FIG. 10. Namely, it is possible to keep the amplitude Y constant. As a result, it is possible to suppress the reduction of the amplitude Y described with reference to FIG. 8 when the pressure in the cuff 2 increases. Further, since the reduction of the amplitude Y is suppressed, the degree of the reduction of the flow rate Q when the pressure in the cuff 2 increases becomes smaller than that in the case shown in FIG. 9 as shown in FIG. 11. Therefore, the pump system 10 can have the superior flow rate characteristic as compared with the case where the AC voltage E is kept constant. In this regard, the language of "the amplitude Y is constant" means not only a state that the amplitude Y is always kept at the target amplitude $Y_t$ but also a state that the amplitude Y fluctuates in the vicinity of the target amplitude $Y_t$ due to a device configuration, a circuit configuration or the like.

Further, according to the pump system 10, it is possible to prevent the control method from being complicated unlike the configuration of the patent document 2 and it is not required to provide a plurality of pump portions having different volumes unlike the configuration of the patent document 3. Therefore, the pump system 10 can provide the superior flow rate characteristic with the simple configuration. Further, the resonant frequency $f_r$ of the vibration actuator 8 is determined by the inertial moment J and the spring constant $K_{sp}$ as described above and does not change depending on the effective value of the AC voltage E. Therefore, it becomes unnecessary to address the abnormal noise, the fault and the like caused by the resonance phenomenon of the pump 5 or it becomes easier to address the abnormal noise, the fault and the like as compared with the case of using the motor as disclosed in the patent document 1, even if necessary. From these points of view, the pump system 10 can provide the superior flow rate characteristic with the simple configuration.

Figure 12:
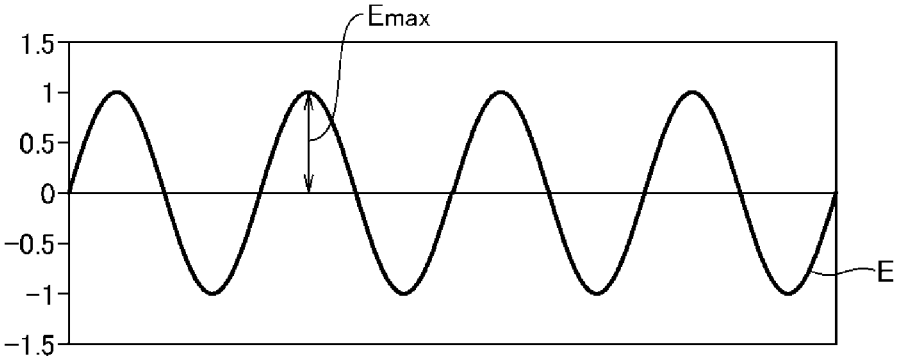
FIG. 12 is a diagram showing one example of a waveform of an alternating-current (AC) voltage.
Figure 13:
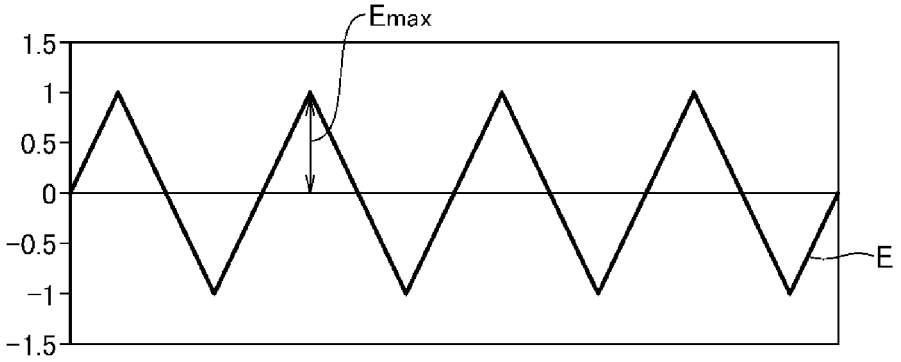
FIG. 13 is a diagram showing another example of the waveform of the AC voltage.
Figure 14:
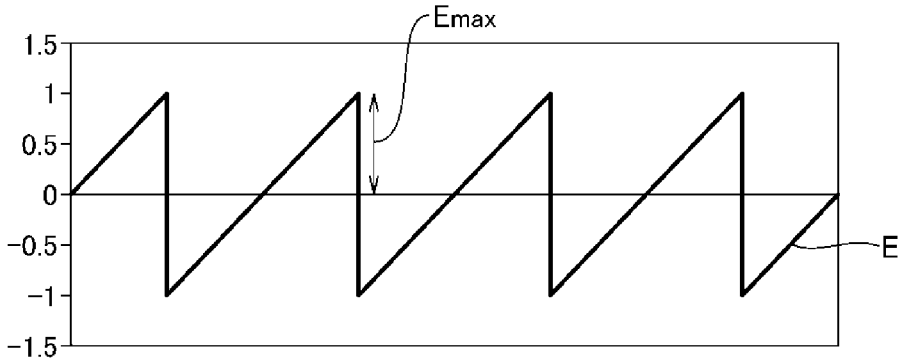
FIG. 14 is a diagram showing yet another example of the waveform of the AC voltage.
Figure 15:
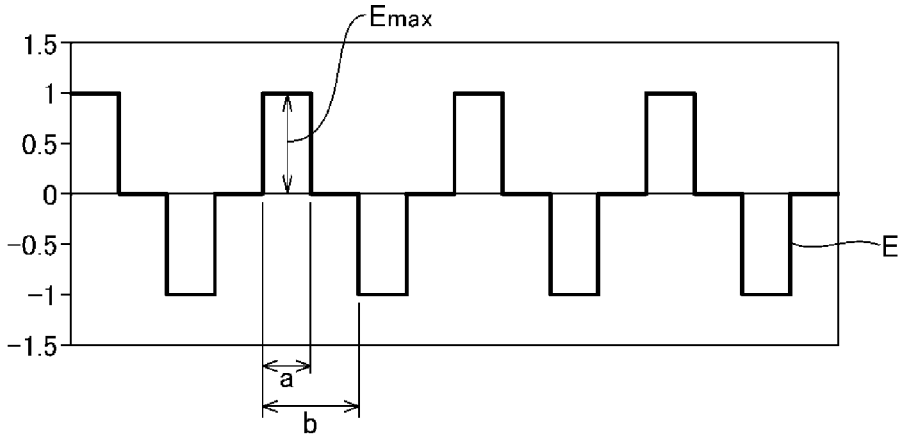
FIG. 15 is a diagram showing yet another example of the waveform of the AC voltage.

In this regard, the waveform of the AC voltage E is not particularly limited to a specific form. For example, the waveform of the AC voltage E may be a sinusoidal wave as shown in FIG. 12, a triangular wave as shown in FIG. 13, a sawtooth wave as shown in FIG. 14 or a rectangular wave as shown in FIG. 15. Among these waveforms, the waveform of the AC voltage can be the sinusoidal wave as shown in FIG. 12 because the sinusoidal wave tends not to cause noises or the like. On the other hand, a waveform generation circuit for generating the sinusoidal wave is likely to be more expensive than waveform generation circuits for the other waveforms. Thus, if it is desired to configure the pump system 10 with a low cost, the waveform of the AC voltage E can be the triangular wave, the sawtooth wave or the rectangular wave.

When the sinusoidal wave, the triangle wave or the sawtooth wave as shown in FIGS. 12, 13 and 14 is used as the AC voltage E, it is possible to use a method of changing a maximum voltage value Emax of the AC voltage for controlling the effective value of the AC voltage E. As the maximum voltage value Emax of the AC voltage E becomes larger, the effective value of the AC voltage E also becomes larger. On the contrary, as the maximum voltage value Emax of the AC voltage E becomes smaller, the effective value of the AC voltage E also becomes smaller.

On the other hand, when the rectangular wave shown in FIG. 15 is used as the AC voltage E, it is possible to use the method of changing the maximum voltage value Emax of the AC voltage E or a method of changing a duty ratio (=a/b)

of the AC voltage E for controlling the effective value of the AC voltage E. As is the case with using the other waveforms as the AC voltage E, as the maximum voltage value Emax of the AC voltage E becomes larger, the effective value of the AC voltage E also becomes larger. On the contrary, as the maximum voltage value Emax of the AC voltage E becomes smaller, the effective value of the AC voltage E also becomes smaller. Further, as the duty ratio of the AC voltage E becomes larger, the effective value of the AC voltage E also becomes larger. On the contrary, as the duty ratio of the AC voltage E becomes smaller, the effective value of the AC voltage E also becomes smaller. The drive control unit 61 may control both or either one of the maximum voltage value Emax and the duty ratio of the AC voltage E. In a case of using the method of controlling both of the maximum voltage value Emax and the duty ratio of the AC voltage E, it is possible to control the effective value of the AC voltage E more accurately as compared with a case of using the method of controlling either one of the maximum voltage value Emax and the duty ratio of the AC voltage E. In the case of using the method of controlling either one of the maximum voltage value Emax and the duty ratio of the AC voltage E, the control of the pump 5 becomes simpler as compared with the case of using the method of controlling both of the maximum voltage value Emax and the duty ratio of the AC voltage E, and thereby it becomes possible to simplify the circuit configuration and the like.

The method for controlling the drive of the pump 5 performed by the drive control unit 61 has been described in the above description. Although the pressure detection unit 62 detects the pressure in the cuff 2 based on the output signal of the pressure sensor 100 and the drive control unit 61 controls the effective value of the AC voltage E based on the detection result of the pressure detection unit 62 in the above-described method for controlling the drive of the pump 5, the method of controlling the drive of the pump 5 is not particularly limited thereto as long as it can control the pump 5 so that the amplitude Y is constant.

For example, the following method can be used. First, an increased amount of the pressure in the cuff 2 per unit time is obtained in advance from an experiment, a simulation or the like based on the volume in the cuff 2 and the flow rate Q provided when the amplitude Y coincides with the target amplitude $Y_t$. Based on the increased amount of the pressure in the cuff 2 per unit time, it is possible to predict a relationship between an elapsed time from a drive start time of the pump 5 and the pressure in the cuff 2 at that elapsed time. Thus, the drive control unit 61 may have (store) a control program containing a table (timing table) in which the elapsed time from the drive start time of the pump 5 is associated with the effective value of the AC voltage E for allowing the amplitude Y to be the target amplitude $Y_t$ at that elapsed time, a calculation formula into which the elapsed time from the drive start time of the pump 5 is substituted for calculating the effective value of the AC voltage E for allowing the amplitude Y to be the target amplitude $Y_t$ at that elapsed time, or the like. Further, the drive of the pump 5 may be controlled based on this control program. According to this method, since it becomes unnecessary to feed back the pressure in the cuff 2, it is possible to make the circuit configuration simpler.

Although the pump system, the fluid supply device and the method for controlling the drive of the pump system of the present disclosure have been described based on the illustrated embodiment, the present disclosure is not limited thereto. The configuration of each part can be replaced with any configuration having a similar function. Further, other optional component(s) may also be added to the present disclosure.

In addition, although the pump system and the fluid supply device are applied to the electronic sphygmomanometer 1 in the above-described embodiment, the present invention is not limited thereto. For example, the pump system and the fluid supply device can be applied to any device which requires the supply of fluid. Further, although the pump 5 has the four pump units 9 in the above-described embodiment, the present disclosure is not limited thereto. For example, the present disclosure involves an aspect in which the pump 5 has at least one pump unit 9.

Further, the configuration of the vibration actuator 8 is not particularly limited as long as the configuration of the vibration actuator 8 allows the amplitude Y of the vibration actuator 8 to change according to the pressure in the sealed chamber(s) 91. For example, although the magnets 83, 84 are provided on the movable body 82 and the coil core portions 85, 86 are provided on the housing 7 in the above-described embodiment, the present disclosure is not limited thereto. The present disclosure involves an aspect in which the arrangement of the magnets 83, 84 and the arrangement of the coil core portions 85, 86 are reversed. Namely, the coil core portions 85, 86 may be provided on the movable body 82 and the magnets 83, 84 may be provided on the housing 7. Further, the magnets 83, 84 may be replaced with electromagnets.

The invention claimed is:

1. A pump system, comprising:

a vibration actuator which can be electromagnetically driven by applying an alternating-current voltage thereto;

a sealed chamber connected to a suction port and a discharge port;

a movable wall for changing a volume of the sealed chamber;

a cuff to be attached to a measurement target part of a user;

a pressure sensor for detecting pressure in the cuff; and a control device for controlling drive of the vibration actuator based on the pressure in the cuff detected by the pressure sensor, wherein the movable wall is displaced due to the drive of the vibration actuator to supply fluid in the sealed chamber into the cuff, wherein the control device is configured to calculate a target effective value for allowing an amplitude of the vibration actuator to be a target amplitude based on the pressure in the cuff detected by the pressure sensor and control the alternating-current voltage so that an effective value of the alternating-current voltage coincides with the target effective value, wherein the vibration actuator includes a shaft portion provided in a housing, a movable body supported by the shaft portion so that the movable body can perform reciprocating rotation with respect to the housing, a pair of coil core portions fixed to one of the housing and the movable body, and magnets provided on another of the housing and the movable body so as to respectively face the coil core portions, and wherein a spring mass system structure for supporting the movable body is constituted of magnetic springs formed by magnetic force acting between the coil core portions and the magnets and fluid springs formed by elastic force of compressed fluid in the pair of sealed chambers.

2. The pump system as claimed in claim 1, wherein the alternating-current voltage is a rectangular wave, and wherein the effective value is controlled by changing at least one of an amplitude and a duty ratio of the alternating-current voltage.

3. The pump system as claimed in claim 1, wherein the vibration actuator has a resonance frequency which changes according to the pressure in the cuff.

4. A fluid supply device, comprising:

the pump system defined by claim 1.

5. A method for controlling drive of a pump system containing a vibration actuator which can be electromagnetically driven by applying an alternating-current voltage thereto, a sealed chamber connected to a suction port and a discharge port, a movable wall for changing a volume of the sealed chamber, a cuff to be attached to a measurement target part of a user, a pressure sensor for detecting pressure in the cuff, and a control device for controlling drive of the vibration actuator based on the pressure in the cuff detected by the pressure sensor, wherein the movable wall is displaced due to drive of the vibration actuator to supply fluid in the sealed chamber into the cuff, the method comprising:

calculating a target effective value for allowing an amplitude of the vibration actuator to be a target amplitude based on the pressure in the cuff detected by the pressure sensor, and controlling the alternating-current voltage so that an effective value of the alternating-current voltage coincides with the target effective value, wherein the vibration actuator includes a shaft portion provided in a housing, a movable body supported by the shaft portion so that the movable body can perform reciprocating rotation with respect to the housing, a pair of coil core portions fixed to one of the housing and the movable body, and magnets provided on another of the housing and the movable body so as to respectively face the coil core portions, and wherein a spring mass system structure for supporting the movable body is constituted of magnetic springs formed by magnetic force acting between the coil core portions and the magnets and fluid springs formed by elastic force of compressed fluid in the pair of sealed chambers.

* * * * *